US008628832B2

(12) United States Patent
Taguri et al.

(10) Patent No.: US 8,628,832 B2
(45) Date of Patent: Jan. 14, 2014

(54) RECORDING MEDIUM

(71) Applicant: Canon Kabushiki Kaisha, Tokyo (JP)

(72) Inventors: Ryo Taguri, Sagamihara (JP); Hisao Kamo, Ushiku (JP); Tetsuro Noguchi, Hachioji (JP); Yasuhiro Nito, Yokohama (JP); Isamu Oguri, Yokohama (JP); Naoya Hatta, Kawasaki (JP); Kazuhiko Araki, Kawasaki (JP); Shinya Yumoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/752,187

(22) Filed: Jan. 28, 2013

(65) Prior Publication Data

US 2013/0196090 A1 Aug. 1, 2013

(30) Foreign Application Priority Data

Jan. 31, 2012 (JP) ..... 2012-018920
Jun. 28, 2012 (JP) ..... 2012-145663

(51) Int. Cl.
*B41M 5/00* (2006.01)
*B41M 5/52* (2006.01)
*B41M 5/50* (2006.01)

(52) U.S. Cl.
CPC ..... *B41M 5/5218* (2013.01); *B41M 5/52* (2013.01); *B41M 5/506* (2013.01); *B41M 5/504* (2013.01); *B41M 5/5254* (2013.01)
USPC ..... 428/32.21; 428/32.22; 428/32.25; 428/32.26; 428/32.31; 428/32.35; 428/32.36

(58) Field of Classification Search
CPC ..... B41M 5/5218; B41M 5/52; B41M 5/506; B41M 5/504; B41M 5/5254
USPC ..... 428/32.21, 32.22, 32.25, 32.26, 32.31, 428/32.35, 32.36
See application file for complete search history.

(56) References Cited

U.S. PATENT DOCUMENTS

2003/0203133 A1* 10/2003 Maekawa ..... 428/32.1
2004/0022968 A1* 2/2004 Liu et al. ..... 428/32.25
2009/0066774 A1* 3/2009 Kubota et al. ..... 347/106

FOREIGN PATENT DOCUMENTS

JP 7-232473 A 9/1995
JP 8-132731 A 5/1996
JP 9-66664 A 3/1997
JP 9-76628 A 3/1997
JP 2004-276418 A 10/2004
JP 2007-254754 A 10/2007
JP 2011-037162 A 2/2011
JP 2011-511316 A 4/2011

* cited by examiner

*Primary Examiner* — Betelhem Shewareged
(74) *Attorney, Agent, or Firm* — Canon USA Inc. IP Division

(57) ABSTRACT

A recording medium includes a base and at least one ink-receiving layer. A first ink-receiving layer that is at least one ink-receiving layer contains inorganic particles having an average primary particle size of 1 μm or less and inorganic particles coated with a metal oxide. The inorganic particles coated with the metal oxide have an average primary particle size of 15.0 μm or more. When the maximum of a FLOP value of the recording medium is denoted by $FLOP_{Max}$ and the minimum of the FLOP value is denoted by $FLOP_{Min}$, the $FLOP_{Min}$ is 2.5 or more and a value of $FLOP_{Min}/FLOP_{Max}$ is 0.80 or more and 1.00 or less.

11 Claims, 1 Drawing Sheet

RECORDING MEDIUM

BACKGROUND OF THE INVENTION

1. Field of the Invention

The present invention relates to a recording medium.

2. Description of the Related Art

A characteristic that has been recently required for an image recorded by an image recording method is high-quality glossiness. As a method for obtaining such an image, a technique for imparting pearl-like glossiness (hereinafter also referred to as "pearly luster") to a recording medium on which an image is to be recorded has been studied. Japanese Patent Laid-Open No. 2004-276418 discloses a recording medium including a base coated with a resin layer containing a pearlescent pigment and a water-soluble resin and an ink-receiving layer. Japanese Patent Laid-Open No. 2011-037162 discloses a recording medium including a base, a first ink-receiving layer containing inorganic particles and a pearlescent pigment, and a second ink-receiving layer containing inorganic particles. PCT Japanese Translation Patent Publication No. 2011-511316 discloses a recording medium including a base coated with a resin layer containing a pearlescent pigment and a polyolefin and an ink-receiving layer. PCT Japanese Translation Patent Publication No. 2011-511316 describes a FLOP value as an index that represents pearly luster.

SUMMARY OF THE INVENTION

According to studies conducted by the inventors of the present invention, although the recording media described in Japanese Patent Laid-Open Nos. 2004-276418 and 2011-037162 and PCT Japanese Translation Patent Publication No. 2011-511316 exhibit pearly luster to a certain degree, the resulting images do not have the high-quality glossiness that has been recently required. That is, the degree of pearly luster is not sufficient.

Accordingly, the present invention provides a recording medium having a high degree of pearly luster.

A recording medium according to an aspect of the present invention includes a base and at least one ink-receiving layer. A first ink-receiving layer that is at least one ink-receiving layer contains inorganic particles having an average primary particle size of 1 μm or less and inorganic particles coated with a metal oxide, and the inorganic particles coated with the metal oxide have an average primary particle size of 15.0 μm or more. When the maximum of a FLOP value of the recording medium represented by the formula below is denoted by $FLOP_{Max}$ and the minimum of the FLOP value is denoted by $FLOP_{Min}$, the $FLOP_{Min}$ is 2.5 or more and a value of $FLOP_{Min}/FLOP_{Max}$ is 0.80 or more and 1.00 or less:

$$\text{FLOP value}=2.69\times(L^*_{15°}-L^*_{110°})^{1.11}/L^*_{45°}0.86$$

where $L^*_{15°}$ denotes a brightness of reflected light at an offset angle of 15°, $L^*_{45°}$ denotes a brightness of reflected light at an offset angle of 45°, and $L^*_{110°}$ denotes a brightness of reflected light at an offset angle of 110°.

According to the aspect of the present invention, a recording medium having a high degree of pearly luster can be provided.

Further features of the present invention will become apparent from the following description of exemplary embodiments with reference to the attached drawings.

DESCRIPTION OF THE EMBODIMENTS

The present invention will be described in detail by way of embodiments. First, a FLOP value, which is an index that represents pearly luster of a recording medium, will be described.

It is known that the degree of pearly luster of an image sensed by human visual observation is highly related to brilliance, brightness, etc. of an image. On the other hand, general glossiness is evaluated by observing specular reflected light with respect to incident light. However, brilliance, brightness, etc. of an image sensed by human visual observation are not necessarily highly related to specular reflected light. In other words, even when the general glossiness of an image is high, a human does not necessarily sense that the brilliance and brightness of the image are high and therefore the image is perceived to have pearly luster by visual observation. To address this problem, a FLOP value is known as an index that represents pearly luster that is highly related to brilliance, brightness, etc. that are sensed by human visual observation. The FLOP value is an index that is mainly used in the field of coating, and is described in Japanese Patent Laid-Open No. 2007-254754 etc.

Specifically, the FLOP value is represented by formula (1) below:

$$\text{FLOP value}=2.69\times(L^*_{15°}-L^*_{110°})^{1.11}/L^*_{45°}0.86 \qquad \text{Formula (1)}$$

$L^*_{15°}$: Brightness of reflected light at an offset angle of 15° with respect to incident light of 45°

$L^*_{45°}$: Brightness of reflected light at an offset angle of 45° with respect to incident light of 45°

$L^*_{110°}$: Brightness of reflected light at an offset angle of 110° with respect to incident light of 45°

Figure 1A:
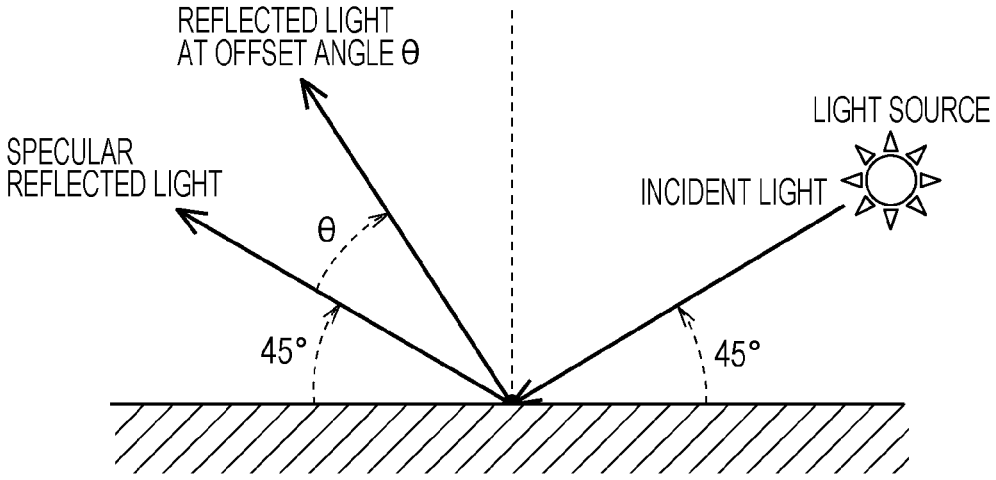
FIGS. 1A and 1B are views illustrating a method for measuring a FLOP value in the present invention.

The reflected light at an offset angle θ (15°, 45°, or 110°) with respect to incident light of 45° is shown in FIG. 1A.

As a result of studies conducted by the inventors of the present invention, it was found that when the FLOP value of a recording medium is equal to or higher than a certain high value, i.e., when the $FLOP_{Min}$, described below is 2.5 or more regardless of the incident direction of light from a light source, a human senses that the brilliance and brightness of an image are high when the human visually observes the image. Furthermore, the $FLOP_{Min}$, is preferably 3.0 or more, and more preferably 4.0 or more.

It was also found that when uniformity of the FLOP value of the recording medium is high, i.e., when the value of $FLOP_{Min}/FLOP_{Max}$ described below is 0.80 or more and 1.00 or less, a human senses that high brilliance and brightness are uniform and thus the image has a higher degree of pearly luster. Furthermore, the value $FLOP_{Min}/FLOP_{Max}$ is preferably 0.85 or more and 1.00 or less, and more preferably 0.90 or more and 1.00 or less.

Figure 1B:
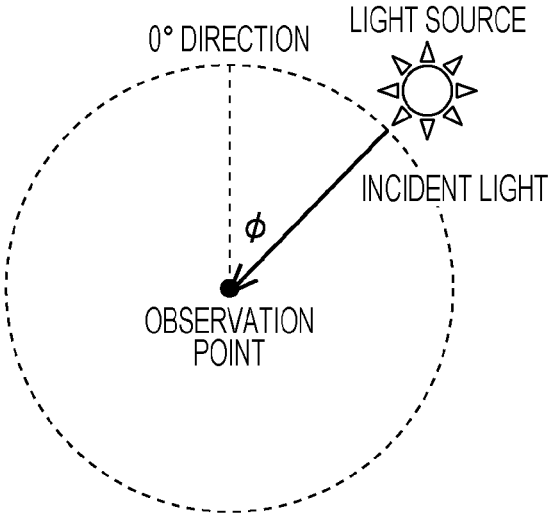

Methods for deriving $FLOP_{Max}$, $FLOP_{Min}$, and $FLOP_{Min}/FLOP_{Max}$ in the present invention will be described below. FIG. 1B is a view of a recording medium when viewed from a direction perpendicular to a surface of the recording medium. First, as illustrated in FIG. 1B, a certain direction from an observation point in the recording medium is defined as the 0° direction. Subsequently, FLOP values (in 36 directions) are measured in increments of 10° in directions of 0° to 360° (one round) of an angle ϕ of a light source with respect to the 0° direction. Next, among the measured FLOP values in the 36 directions, with regard to a direction that provides the maximum FLOP value and a direction that provides the minimum FLOP value, the FLOP values are further measured in directions of ±5° in increments of 1°. Among these FLOP values, the maximum is defined as $FLOP_{Max}$ and the minimum is defined as $FLOP_{Min}$. The value $FLOP_{Min}/FLOP_{Max}$ is calculated from the $FLOP_{Max}$ and $FLOP_{Min}$. In the present invention, $L^*_{15°}$, $L^*_{45°}$, and $L^*_{110°}$ in the formula that represents the FLOP value are measured using a gonio-spectrophotometric color measurement system GCMS-3B (manufactured by Murakami Color Research Laboratory Co., Ltd.).

Recording Medium

A recording medium according to an embodiment of the present invention includes a base and at least one ink-receiving layer. In the present invention, the recording medium may be a recording medium for ink jet used in an ink jet recording method. Components constituting the recording medium according to an embodiment of the present invention will be described below.

<Base>

Examples of the base include a base including only base paper and a base including base paper and a resin layer, i.e., base paper coated with a resin. In the present invention, a base including base paper and a resin layer may be used. In such a case, the resin layer may be provided only on one surface of the base paper or the resin layer may be provided on both surfaces of the base paper.

The base paper is obtained by using wood pulp as a main material, and using synthetic pulp such as polypropylene or synthetic fiber such as nylon or polyester in addition to the wood pulp, as needed, to make paper. Examples of the wood pulp include laubholz bleached kraft pulp (LBKP), laubholz bleached sulfite pulp (LBSP), nadelholz bleached kraft pulp (NBKP), nadelholz bleached sulfite pulp (NBSP), laubholz dissolving pulp (LDP), nadelholz dissolving pulp (NDP), laubholz unbleached kraft pulp (LUKP), and nadelholz unbleached kraft pulp (NUKP). These may be used alone or in combination of two or more thereof. Among these various types of wood pulp, LBKP, NBSP, LBSP, NDP, and LDP, which have a high content of a short fiber component, are suitably used. The pulp may be chemical pulp (sulfate pulp or sulfite pulp) that have a low impurity content. Pulp subjected to a bleaching treatment to improve the degree of whiteness may also be used. A sizing agent, a white pigment, a paper-strengthening agent, a fluorescent brightening agent, a water-retaining agent, a dispersant, a softening agent, and the like may be suitably added into the base paper.

In the present invention, a paper density of the base paper specified in JIS P 8118 is preferably 0.6 g/m$^3$ or more and 1.2 g/m$^3$ or less. Furthermore, the paper density is more preferably 0.7 g/m$^3$ or more and 1.2 g/m$^3$ or less.

In the present invention, when the base includes a resin layer, the thickness of the resin layer is preferably 50 μm or more and 60 μm or less. In the present invention, the thickness of the resin layer is calculated by the following method. First, a cross section of a recording medium is cut with a microtome, and the cross section is observed with a scanning electron microscope. Next, the thicknesses at arbitrary 100 points or more of the resin layer are measured, and the average thereof is defined as the thickness of the resin layer. Thicknesses of other layers in the present invention are also calculated by the same method.

A resin used in the resin layer may be a thermoplastic resin. Examples of the thermoplastic resin include acrylic resins, acrylic silicone resins, polyolefin resins, and styrene-butadiene copolymers. Among these resins, polyolefin resins are suitably used. In the present invention, the term "polyolefin resin" refers to a polymer obtained by using an olefin as a monomer. Specific examples thereof include homopolymers of ethylene, propylene, isobutylene, or the like and copolymers thereof. These polyolefin resins may be used alone or in combination of two or more resins, as required. Among these polyolefin resins, polyethylene is suitably used. Low-density polyethylene (LDPE) and high-density polyethylene (HDPE) are suitably used as polyethylene. The resin layer may contain a white pigment, a fluorescent brightening agent, ultramarine, etc. in order to adjust opacity, the degree of whiteness, hue, etc. Among these, a white pigment is suitably contained because opacity can be improved. Examples of the white pigment include rutile titanium dioxide and anatase titanium dioxide.

<Ink-Receiving Layer>

In the present invention, an ink-receiving layer may be provided on only one surface of the base or on both surfaces of the base. The thickness of the ink-receiving layer is preferably 18 μm or more and 60 μm or less. In the present invention, the ink-receiving layer may be a single layer or a multilayer of two or more layers. In the description below, one of at least one ink-receiving layer is referred to as a "first ink-receiving layer". For example, when the ink-receiving layer is a single layer, the only one ink-receiving layer serves as the first ink-receiving layer. When the ink-receiving layer is a multilayer, one of a plurality of ink-receiving layers serves as the first ink-receiving layer.

In the present invention, a dry coating amount of the ink-receiving layer is preferably 18.0 g/m$^2$ or more and 55.0 g/m$^2$ or less, and more preferably 18.0 g/m$^2$ or more and 50.0 g/m$^2$ or less. Herein, when the ink-receiving layer is a multilayer, the term "dry coating amount of the ink-receiving layer" refers to the total amount of dry coating of all layers. Materials that can be incorporated in the ink-receiving layer will be respectively described below.

(First Ink-Receiving Layer)

In the present invention, the thickness of the first ink-receiving layer is preferably 18 μm or more and 50 μm or less.

(1) Inorganic Particles

In the present invention, the first ink-receiving layer contains inorganic particles having an average primary particle size of 1 μm or less (hereinafter also simply referred to as "inorganic particles"). The average primary particle size of the inorganic particles is preferably 0.1 nm or more and 500 nm or less, more preferably 1 nm or more and 300 nm or less, and particularly preferably 5 nm or more and 250 nm or less. In the present invention, the average primary particle size of inorganic particles is a number-average particle size of the diameters of circles having the areas equal to the projected areas of primary particles of the inorganic particles when the inorganic particles are observed with an electron microscope. In this case, the measurement is conducted at at least 100 points.

In the present invention, the inorganic particles may be used in an ink-receiving layer coating liquid in a state where the inorganic particles are dispersed with a dispersant. An average secondary particle size of the inorganic particles in the dispersed state is preferably 0.1 nm or more and 500 nm or less, more preferably 1.0 nm or more and 300 nm or less, and particularly preferably 10 nm or more and 250 nm or less. The average secondary particle size of the inorganic particles in the dispersed state can be measured by a dynamic light scattering method.

In the present invention, the content (% by mass) of the inorganic particles in the ink-receiving layer is preferably 30% by mass or more and 95% by mass or less.

Examples of the inorganic particles used in the present invention include hydrated alumina, alumina, silica, colloidal silica, titanium dioxide, zeolite, kaolin, talc, hydrotalcite, zinc oxide, zinc hydroxide, aluminum silicate, calcium silicate, magnesium silicate, zirconium oxide, and zirconium hydroxide. These inorganic particles may be used alone or in combination of two or more inorganic particles, as required. Among the above inorganic particles, hydrated alumina, alumina, and silica, all of which can form a porous structure having a high ink-absorption property, are suitably used.

Examples of alumina used in the ink-receiving layer include γ-alumina, α-alumina, δ-alumina, θ-alumina, and χ-alumina. Among these, from the standpoint of the optical density of an image and the ink-absorption property, γ-alumina is suitably used. A specific example of γ-alumina is AEROXIDE Alu C (manufactured by EVONIK Industries).

Hydrated alumina represented by general formula (X) can be suitably used in the ink-receiving layer:

$$Al_2O_{3-n}(OH)_{2n}.mH_2O \qquad \text{General formula (X)}$$

(wherein n represents 0, 1, 2, or 3, m is 0 or more and 10 or less, preferably 0 or more and 5 or less, however, m and n are not zero at the same time.) Note that m may not represent an integer because $mH_2O$ often represents a removable aqueous phase that does not relate to the formation of a crystal lattice. In addition, m can reach zero when the hydrated alumina is heated.

In the present invention, hydrated alumina can be produced by a known method. Specifically, examples thereof include a method in which an aluminum alkoxide is hydrolyzed, a method in which sodium aluminate is hydrolyzed, and a method in which an aqueous solution of sodium aluminate is neutralized by adding an aqueous solution of aluminum sulfate or aluminum chloride thereto.

Known crystal structures of hydrated alumina include amorphous, gibbsite, and boehmite in accordance with a heat-treatment temperature. The crystal structures of hydrated alumina can be analyzed by X-ray diffractometry. In the present invention, among these, hydrated alumina having a boehmite structure or amorphous hydrated alumina is suitably used. Specific examples thereof include hydrated alumina described in, for example, Japanese Patent Laid-Open Nos. 7-232473, 8-132731, 9-66664, and 9-76628. Examples of commercially available hydrated alumina include DISPERAL HP14 and HP18 (manufactured by Sasol). These may be used alone or in combination of two or more thereof, as required.

In the present invention, hydrated alumina has a specific surface area of preferably 100 $m^2/g$ or more and 200 $m^2/g$ or less, and more preferably 125 $m^2/g$ or more and 175 $m^2/g$ or less, the specific surface area being determined by a BET method. The BET method is a method in which a molecule or an ion having a known size is allowed to be adsorbed on a surface of a sample, and the specific surface area of the sample is measured on the basis of the amount of adsorption. In the present invention, nitrogen gas is used as a gas that is allowed to be adsorbed on a sample.

Hydrated alumina and alumina used in the present invention may be mixed with an ink-receiving layer coating liquid in the form of an aqueous dispersion. An acid may be used as a dispersant thereof. As for the acid, a sulfonic acid represented by general formula (Y) is suitably used because an effect of suppressing bleeding of an image can be obtained:

$$R—SO_3H \qquad \text{General formula (Y)}$$

(wherein R represents a hydrogen atom, an alkyl group having 1 to 3 carbon atoms, or an alkenyl group having 1 to 3 carbon atoms, and R may be substituted with an oxo group, a halogen atom, an alkoxy group, or an acyl group.)

Silica used in the ink-receiving layer is broadly divided into two types of silica, namely, silica obtained by a wet process and silica obtained by a dry process (gas-phase process) in terms of production process thereof. A known wet process is a method in which active silica is produced by an acid decomposition of a silicate, the active silica is appropriately polymerized to coagulate and sediment the polymerized product to obtain hydrated silica. Examples of a known dry process (gas-phase process) include a method for obtaining anhydrous silica by a method (flame hydrolysis) in which a silicon halide is hydrolyzed in a gas phase at a high temperature or a method (arc process) in which quartz sand and coke are heated, reduced, and gasified by arc in an electric furnace, and the resulting gas is oxidized with air. In the present invention, silica obtained by the dry process (gas-phase process) (hereinafter also referred to as "gas-phase process silica") may be used. The reason for this is as follows. Gas-phase process silica has a particularly large specific surface area and thus has a particularly high ink-absorption property. In addition, gas-phase process silica has a low refractive index and thus can impart transparency to the ink-receiving layer, thereby obtaining good color developability. Specific examples of gas-phase process silica include AEROSIL (manufactured by Nippon Aerosil Co., Ltd.) and Reolosil QS series (manufactured by TOKUYAMA Corporation).

In the present invention, the specific surface area of gas-phase process silica measured by the BET method is preferably 50 $m^2/g$ or more and 400 $m^2/g$ or less, and more preferably 200 $m^2/g$ or more and 350 $m^2/g$ or less.

In the present invention, hydrated alumina, alumina, and silica may be used as a mixture. Specifically, at least two selected from hydrated alumina, alumina, and silica may be mixed in the form of powder and dispersed to prepare a dispersion liquid.

(2) Inorganic Particles Coated with Metal Oxide

In the present invention, the first ink-receiving layer contains inorganic particles coated with a metal oxide and having an average primary particle size of 15.0 μm or more. By incorporating the inorganic particles coated with a metal oxide and having such a large particle size, pearly luster can be imparted to a recording medium.

In the present invention, regarding the inorganic particles coated with a metal oxide, it is sufficient that part of the surfaces of the inorganic particles is coated with the metal oxide. However, a coating ratio of the metal oxide (surface area of inorganic particles coated with metal oxide/total surface area of inorganic particles) is preferably 95% or more, and more preferably 100%, that is, the entire surfaces of the inorganic particles are more suitably coated with the metal oxide.

A ratio of the mass of the metal oxide to the total mass of the inorganic particles coated with a metal oxide is preferably 5.0% by mass or more and 80.0% by mass or less, and more preferably 10.0% by mass or more and 70.0% by mass or less.

In the present invention, the content of the inorganic particles coated with a metal oxide, the inorganic particles being contained in the first ink-receiving layer, is preferably 4.6% by mass or more and 37.9% by mass or less, and more preferably 5.0% by mass or more and 25.0% by mass or less relative to the content of inorganic particles. By controlling the content in the above suitable range, pearly luster of the recording medium is further enhanced, and the ink-absorption property of the recording medium is also improved.

The average primary particle size of the inorganic particles coated with a metal oxide is 15.0 μm or more. The average primary particle size of the inorganic particles coated with a metal oxide is preferably 300 μm or less, more preferably 250 μm or less, and particularly preferably 50 μm or less. In the present invention, the average primary particle size of the inorganic particles coated with a metal oxide is a number-average particle size of the diameters of circles having the areas equal to the projected areas of primary particles when the particles are observed with an optical microscope. In this case, the measurement is conducted at at least 100 points.

The inorganic particles coated with a metal oxide may each have a plate-like shape. In the present invention, the term "plate-like shape" means that a ratio of the average primary particle size to the average particle thickness described below is 5 or more. In the present invention, when the inorganic particles coated with a metal oxide have a plate-like shape, the average particle thickness of the particles is preferably 1.0 μm or less. In the present invention, the average particle thickness of the inorganic particles coated with a metal oxide is determined by selecting arbitrary 100 inorganic particles in observation with an electron microscope, and calculating from the number average of the thicknesses of the 100 inorganic particles.

In the present invention, the content of the inorganic particles coated with a metal oxide, the inorganic particles being contained in the ink-receiving layer, is preferably 1.0 g/m$^2$ or more and 8.0 g/m$^2$ or less, and more preferably 2.0 g/m$^2$ or more and 5.0 g/m$^2$ or less. By controlling the content in the above range, pearly luster can be more effectively obtained. Furthermore, when the content of the inorganic particles coated with a metal oxide, the inorganic particles being contained in the ink-receiving layer, is 8.0 g/m$^2$ or less, bleeding of an image in a high-humidity environment can be effectively suppressed.

Examples of the inorganic particles used in the inorganic particles coated with a metal oxide include natural mica, synthetic mica, alumina, hydrated alumina, and silica. Among these, natural mica and synthetic mica are suitable. Examples of the metal oxide include titanium dioxide, iron oxide, and tin oxide. Among these, titanium dioxide is suitable. Specifically, mica coated with titanium dioxide is particularly suitably used.

(3) Binder

In the present invention, the first ink-receiving layer may further contain a binder. In the present invention, the term "binder" refers to a material that can bind inorganic particles to form a coating film.

In the present invention, from the standpoint of the ink-absorption property, the content of the binder in the ink-receiving layer is preferably 3.0% by mass or more and 30.0% by mass or less, and more preferably 5.0% by mass or more and 25.0% by mass or less relative to the content of the inorganic particles.

Examples of the binder include starch derivatives such as oxidized starch, etherified starch, and phosphoric acid-esterified starch; cellulose derivatives such as carboxymethyl cellulose and hydroxyethyl cellulose; casein, gelatin, soybean protein, polyvinyl alcohol, and derivatives thereof; polyvinyl pyrrolidone; maleic anhydride resins; latexes of conjugated polymers such as styrene-butadiene copolymers and methyl methacrylate-butadiene copolymers; latexes of acrylic polymers such as acrylic acid ester and methacrylic acid ester polymers; latexes of vinyl polymers such as ethylene-vinyl acetate copolymers; functional-group-modified polymer latexes obtained by modifying the above-described polymers with a monomer having a functional group such as a carboxyl group; cationized polymers obtained by cationizing the above-described polymers with a cationic group; cationized polymers obtained by cationizing the surfaces of the above-described polymers with a cationic surfactant; polymers on the surfaces of which polyvinyl alcohol is distributed, the polymers being obtained by polymerizing a monomer constituting any of the above-described polymers in the presence of cationic polyvinyl alcohol; polymers on the surfaces of which cationic colloidal particles are distributed, the polymers being obtained by polymerizing a monomer constituting any of the above-described polymers in a suspended dispersion of the cationic colloidal particles; aqueous binders such as thermosetting synthetic resins, e.g., a melamine resin and a urea resin; polymers and copolymers of acrylic acid esters and methacrylic acid esters, such as polymethyl methacrylate; and synthetic resins such as polyurethane resins, unsaturated polyester resins, vinyl chloride-vinyl acetate copolymers, polyvinyl butyral, and alkyd resins. These binders may be used alone or in combination of two or more binders, as required.

Among the above binders, polyvinyl alcohol and polyvinyl alcohol derivatives are suitably used. Examples of the polyvinyl alcohol derivatives include cation-modified polyvinyl alcohol, anion-modified polyvinyl alcohol, silanol-modified polyvinyl alcohol, and polyvinyl acetal.

Polyvinyl alcohol can be synthesized by, for example, saponifying polyvinyl acetate. The degree of saponification of polyvinyl alcohol is preferably 80% by mole or more and 100% by mole or less, and more preferably 85% by mole or more and 100% by mole or less. Note that the degree of saponification is a ratio of the number of moles of hydroxyl group generated by a saponification reaction when polyvinyl alcohol is obtained by saponifying polyvinyl acetate. A value measured in accordance with the method described in JIS-K6726 is used in the present invention. An average degree of polymerization of polyvinyl alcohol is preferably 1,500 or more and 5,000 or less, and more preferably 2,000 or more and 5,000 or less. In the present invention, the viscosity-average degree of polymerization determined in accordance with the method described in JIS-K6726 is used as the average degree of polymerization.

In preparation of an ink-receiving layer coating liquid, polyvinyl alcohol or a polyvinyl alcohol derivative may be used in the form of an aqueous solution. In such a case, the solid content of the polyvinyl alcohol or the polyvinyl alcohol derivative in the aqueous solution is preferably 3% by mass or more and 20% by mass or less.

(4) Cross-Linking Agent

In the present invention, the first ink-receiving layer may further contain a cross-linking agent. By incorporating a cross-linking agent, a disorder of orientation of the inorganic particles coated with a metal oxide can be suppressed. Specifically, when a cross-linking agent is not contained, a movement of moisture occurs in the ink-receiving layer during drying, and the orientation of the inorganic particles coated with the metal oxide may be disordered. In contrast, when a cross-linking agent is contained, the viscosity increases and thus a movement of moisture in the ink-receiving layer during drying is suppressed. Thus, the orientation of the inorganic particles coated with the metal oxide is not easily disordered.

Examples of a method for introducing a cross-linking agent into the first ink-receiving layer include a method in which a cross-linking agent is incorporated in an ink-receiving layer coating liquid and a method in which a layer containing a cross-linking agent (hereinafter also referred to as an "undercoat layer") is formed between an ink-receiving layer and a base so that the cross-linking agent is caused to diffuse and permeate in an ink-receiving layer coating liquid applied onto the undercoat layer. When the former method is employed, the content of the cross-linking agent in the ink-receiving layer is preferably 40% by mass or more and 60% by mass or less, and more preferably 40% by mass or more and 50% by mass or less relative to the content of the binder. When the latter method is employed, the content of the cross-linking agent in the ink-receiving layer is preferably 1% by mass or more and 60% by mass or less, and more preferably 5% by mass or more and 50% by mass or less relative to the content of the binder. In the present invention, the latter method is more suitable.

Examples of the cross-linking agent include aldehyde compounds, melamine compounds, isocyanate compounds, zirconium compounds, amide compounds, aluminum compounds, boric acid, and borates. These cross-linking agents may be used alone or in combination of two or more compounds, as required. In particular, when polyvinyl alcohol or a polyvinyl alcohol derivative is used as the binder, among the cross-linking agents described above, boric acid or a borate is suitably used.

Examples of boric acid include orthoboric acid ($H_3BO_3$), metaboric acid, and diboric acid. The borate may be a water-soluble salt of any of the above boric acids. Examples thereof include alkali metal salts of boric acid such as a sodium salt of boric acid and a potassium salt of boric acid; alkaline earth metal salts of boric acid such as a magnesium salt of boric acid and a calcium salt of boric acid; and ammonium salts of boric acid. Among these, orthoboric acid is suitably used from the standpoint of the stability of the coating liquid with time, and an effect of suppressing the generation of cracks.

(5) Other Additives

In the present invention, the first ink-receiving layer may contain additives other than the components described above. Specific examples of the additives include a pH adjustor, a thickener, a fluidity improver, an antifoaming agent, a foam inhibitor, a surfactant, a mold-releasing agent, a penetrant, a color pigment, a color dye, a fluorescent brightening agent, an ultraviolet absorber, an antioxidant, an antiseptic agent, an antifungal agent, a waterproofing agent, a dye fixing agent, a curing agent, and a weather resistant material.

(Second Ink-Receiving Layer)

In the present invention, in the case where the ink-receiving layer is a multilayer, a second ink-receiving layer may further be provided on the first ink-receiving layer. The second ink-receiving layer preferably has a thickness of 18 μm or more and 55 μm or less.

In the present invention, the second ink-receiving layer may contain inorganic particles having an average primary particle size of 1 μm or less and a binder. The inorganic particles and the binder exemplified in the first ink-receiving layer can be used as the inorganic particles and the binder in the second ink-receiving layer. The inorganic particles and the binder in the second ink-receiving layer may be the same as or different from those in the first ink-receiving layer.

The second ink-receiving layer may contain inorganic particles coated with a metal oxide. The content of the inorganic particles coated with a metal oxide is preferably 3.0% by mass or less, and more preferably 2.0% by mass or less relative to the content of the inorganic particles in the second ink-receiving layer. Furthermore, preferably, the second ink-receiving layer does not contain inorganic particles coated with a metal oxide.

<Undercoat Layer>

As described above, in the present invention, an undercoat layer containing a cross-linking agent may be provided between an ink-receiving layer and a base.

The cross-linking agent contained in the undercoat layer may be the same as the cross-linking agent exemplified as a material that may be contained in the ink-receiving layer. However, borax is more suitably used. Borax has a very high cross-linking reactivity with a binder. Thus, if borax is incorporated in an ink-receiving layer coating liquid, a cross-linking reaction may be completed before coating. Therefore, borax is not suitably used in the ink-receiving layer. In contrast, when borax is incorporated in the undercoat layer, a cross-linking reaction starts at the time when an ink-receiving layer coating liquid is applied onto the undercoat layer. Therefore, borax can be used as a cross-linking agent. From the standpoint of high cross-linking reactivity of borax, borax is rather suitable because it can rapidly cause a cross-linking reaction as compared with other cross-linking agents exemplified above. In the case where an ink-receiving layer coating liquid is applied onto an undercoat layer containing borax, at the time when the borax diffuses and permeates in the coating liquid and contacts a binder, the borax rapidly causes a cross-linking reaction and can increase the viscosity of the coating liquid. As a result, it is possible to suppress a phenomenon that the orientation of inorganic particles coated with a metal oxide is disordered by a movement of moisture during drying of the coating liquid. Thus, a recording medium that satisfies the above-described conditions of the FLOP value can be easily obtained.

Borax and a cross-linking agent exemplified above may be used in combination. In such a case, the content of the cross-linking agent other than borax relative to the content of the borax is preferably 1.0% by mass or more and 50.0% by mass or less, and more preferably 5.0% by mass or more and 40.0% by mass or less.

When the undercoat layer contains borax as a cross-linking agent, the content of borax is preferably 0.1 $g/m^2$ or more and 1.2 $g/m^2$ or less, and more preferably 0.1 $g/m^2$ or more and 1.0 $g/m^2$ or less in terms of dry coating amount.

As described above, borax can be subjected to a cross-linking reaction with a binder. In particular, borax has high reactivity with polyvinyl alcohol and polyvinyl alcohol derivatives. Therefore, the total content of polyvinyl alcohol and polyvinyl alcohol derivatives in the undercoat layer is preferably 0.1% by mass or less, and more preferably 0.01% by mass or less relative to the content of borax. Furthermore, preferably, the undercoat layer does not contain polyvinyl alcohol or polyvinyl alcohol derivatives.

The undercoat layer may further contain other additives exemplified as materials that can be used in the ink-receiving layer.

<Back Coat Layer>

In the present invention, a back coat layer may be provided on a surface of a base, the surface opposite to a surface having an ink-receiving layer thereon. The back coat layer may contain a white pigment, a binder, etc. The thickness of the back coat layer is preferably 0.1 μm or more and 10 μm or less.

Method for Producing Recording Medium

In the present invention, a method for producing a recording medium is not particularly limited. However, the method for producing a recording medium may include a step of preparing an ink-receiving layer coating liquid, and a step of applying the ink-receiving layer coating liquid onto a base. A method for producing a recording medium will be described below.

<Method for Preparing Base>

In the present invention, a generally used method for making paper can be used as a method for preparing base paper. Examples of a paper machine include a Fourdrinier machine, a cylinder machine, a drum machine, and a twin-wire machine. In order to increase the surface smoothness of base paper, a surface treatment may be performed by applying heat and a pressure during or after a papermaking process. Specific examples of the surface treatment method include a calender treatment such as machine calendering and super calendering.

Examples of a method for providing a resin layer on base paper, i.e., a method for coating base paper with a resin, include a melt extrusion method, a wet lamination method, and a dry lamination method. Among these methods, a melt extrusion method in which a molten resin is extruded on a surface or both surfaces of base paper to coat the base paper with the resin is suitable. An example of a widely used method is a method (also referred to as an "extrusion coating method") including bringing a resin extruded from an extrusion die into contact with base paper that has been conveyed at a nip point between a nip roller and a cooling roller, and press-bonding the resin and the base paper with a nip to laminate the base paper with a resin layer. In the formation of a resin layer by the melt extrusion method, a pretreatment may be conducted so that the base paper and the resin layer more firmly adhere to each other. Examples of the pretreatment include an acid etching treatment with a mixture of sulfuric acid and chromic acid, a flame treatment with a gas flame, an ultraviolet irradiation treatment, a corona discharge treatment, a glow discharge treatment, and an anchor coating treatment with an alkyl titanate or the like. Among these pretreatments, a corona discharge treatment is suitable.

In the case where an undercoat layer and a back coat layer are formed, an undercoat layer coating liquid and a back coat layer coating liquid may be prepared in advance, and these liquids may be applied onto a base.

<Method for Forming Ink-Receiving Layer>

In the recording medium according to an embodiment of the present invention, for example, the following methods can be employed as a method for forming an ink-receiving layer on a base. First, an ink-receiving layer coating liquid is prepared. Next, the coating liquid is applied onto the base and dried to prepare a recording medium according to an embodiment of the present invention. In the method for applying the coaling liquid, for example, a curtain coater, a coater with an extrusion system, or a coater with a slide hopper system may be used. The coating liquid may be heated during coating. Examples of the drying method after coating include methods using a hot-air dryer such as a linear tunnel dryer, an arch dryer, an air-loop dryer, or a sine-curve air float dryer; and methods using a dryer that uses infrared rays, heating, microwaves, or the like.

In particular, a recording medium that satisfies the above conditions of the FLOP value can be easily produced by employing a method including a step of forming an undercoat layer containing borax on a base, a step of applying an ink-receiving layer coating liquid on the undercoat layer, and a step of drying the ink-receiving layer coating liquid.

EXAMPLES

The present invention will be described in more detail by way of Examples and Comparative Examples. The present invention is not limited to the Examples below as long as the gist of the present invention is not exceeded. Note that the term "part" in the description of Examples below is on a mass basis unless otherwise stated.

Preparation of Recording Medium

<Preparation of Base>

Eighty parts of LBKP having a freeness of 450 mL in terms of Canadian Standard Freeness (CSF), 20 parts of NBKP having a freeness of 480 mL in terms of Canadian Standard Freeness (CSF), 0.60 parts of cationized starch, 10 parts of heavy calcium carbonate, 15 parts of light calcium carbonate, 0.10 parts of an alkyl ketene dimer, and 0.030 parts of cationic polyacrylamide were mixed. Water was added to the resulting mixture such that the mixture had a solid content of 3.0% by mass, thereby preparing a paper material. Subsequently, the paper material was subjected to paper making with a Fourdrinier machine, in which three-stage wet pressing was performed, followed by drying with a multi-cylinder dryer. The resulting paper was then impregnated with an aqueous solution of oxidized starch using a size press device so as to have a solid content of 1.0 g/m$^2$ after drying, and then dried. Furthermore, the paper was subjected to machine calendering to prepare base paper having a basis weight of 110 g/m$^2$, a Stockigt sizing degree of 100 seconds, an air permeability of 50 seconds, a Bekk smoothness of 30 seconds, a Gurley stiffness of 11.0 mN, and a thickness of 120 μm. Next, a resin composition containing 70 parts of low-density polyethylene, 20 parts of high-density polyethylene, and 10 parts of titanium oxide was applied onto a surface of the base paper such that the dry coating amount was 25 g/m$^2$. This surface is referred to as a main surface of the base. Furthermore, a resin composition containing 50 parts of low-density polyethylene and 50 parts of high-density polyethylene was applied onto another surface of the base paper, thus preparing a base.

<Preparation of Undercoat Layer Coating Liquid>

An undercoat layer coating liquid was prepared by dissolving borax in ion-exchange water such that the content of borax was 5% by mass.

<Preparation of Ink-Receiving Layer Coating Liquid>

(Preparation of Colloidal Sol A)

Hydrated alumina DISPERAL HP14 (manufactured by Sasol) was added to ion-exchange water such that the solid content of the hydrated alumina was 25% by mass. Next, 1.4 parts of methanesulfonic acid was added thereto relative to 100 parts of the solid content of the hydrated alumina, and the resulting mixture was stirred. Furthermore, ion-exchange water was added such that the solid content of hydrated alumina was 21% by mass. Thus, a colloidal sol A was prepared.

(Preparation of Colloidal Sol B)

Iriodin 100 (manufactured by Merck KGaA), which is mica coated with titanium dioxide, was added to ion-exchange water such that the solid content was 25% by mass to prepare a colloidal sol B. Iriodin 100 has a plate-like shape, an average primary particle size of 22 μm, and a ratio of the mass of titanium dioxide to the total mass of the mica coated with titanium dioxide of 29.0% by mass. The average particle thickness of the mica in the colloidal sol B, the mica being coated with titanium dioxide, was 0.5 μm.

(Preparation of First Ink-Receiving Layer Coating Liquid)

The colloidal sol A and the colloidal sol B prepared above were appropriately mixed to prepare colloidal sol mixtures such that the ratios of the content of hydrated alumina to the content of mica coated with titanium dioxide (hydrated alumina:mica coated with titanium dioxide) were the values shown in Table 1. Next, the colloidal sol mixture, an aqueous solution of polyvinyl alcohol (aqueous solution of PVA 235 (manufactured by Kuraray Co., Ltd.) having a degree of polymerization of 3,500 and a degree of saponification of 88% by mole, the aqueous solution having a solid content of 8% by mass), and an aqueous solution of boric acid (having a solid content of 3% by mass) were mixed such that the ratios of the solids (hydrated alumina:polyvinyl alcohol:mica coated with titanium dioxide:boric acid) were the values shown in Table 1. Thus, first ink-receiving layer coating liquids were prepared.

TABLE 1

| Condition for preparation of first ink-receiving layer coating liquid (Unit: parts by mass) | | | | |
|---|---|---|---|---|
| | Hydrated alumina:PVA:Mica coated with $TiO_2$:Boric acid | | | |
| Ink-receiving layer coating liquid No. | Hydrated alumina | PVA | Mica coated with $TiO_2$ | Boric acid |
| Ink-receiving layer coating liquid No. 1 | 100.00 | 13.00 | 13.90 | 0.75 |
| Ink-receiving layer coating liquid No. 2 | 100.00 | 13.00 | 4.60 | 0.75 |
| Ink-receiving layer coating liquid No. 3 | 100.00 | 13.00 | 9.20 | 0.75 |
| Ink-receiving layer coating liquid No. 4 | 100.00 | 13.00 | 18.50 | 0.75 |
| Ink-receiving layer coating liquid No. 5 | 100.00 | 13.00 | 23.10 | 0.75 |
| Ink-receiving layer coating liquid No. 6 | 100.00 | 13.00 | 37.90 | 0.75 |
| Ink-receiving layer coating liquid No. 7 | 100.00 | 13.00 | 23.10 | 0.75 |
| Ink-receiving layer coating liquid No. 8 | 100.00 | 13.00 | 17.30 | 0.75 |
| Ink-receiving layer coating liquid No. 9 | 100.00 | 13.00 | 11.50 | 0.75 |
| Ink-receiving layer coating liquid No. 10 | 100.00 | 13.00 | 9.90 | 0.75 |
| Ink-receiving layer coating liquid No. 11 | 100.00 | 13.00 | 8.70 | 0.75 |
| Ink-receiving layer coating liquid No. 12 | 100.00 | 13.00 | 13.90 | 5.40 |
| Ink-receiving layer coating liquid No. 13 | 100.00 | 13.00 | 13.90 | 0.75 |
| Ink-receiving layer coating liquid No. 14 | 100.00 | 13.00 | 13.90 | 2.60 |
| Ink-receiving layer coating liquid No. 15 | 100.00 | 13.00 | 0 | 0.75 |
| Ink-receiving layer coating liquid No. 16 | 0 | 8.00 | 10.00 | 2.00 |

(Preparation of Second Ink-Receiving Layer Coating Liquid)

The colloidal sol A and the aqueous solution of polyvinyl alcohol prepared above were mixed such that the solid content of polyvinyl alcohol was 7 parts relative to 100 parts of the solid content of hydrated alumina. Subsequently, an aqueous solution of boric acid (having a solid content of 3% by mass) was added to the mixture such that the solid content of boric acid was 16.4 parts relative to 100 parts of the solid content of polyvinyl alcohol. Thus, a second ink-receiving layer coating liquid was prepared.

<Preparation of Recording Medium>

(Preparation of Recording Media 1 to 25)

The undercoat layer coating liquid prepared above was applied onto the main surface of the base obtained above using a gravure coater such that the dry coating amount ($g/m^2$) was each value shown in Table 2, and dried to form an undercoat layer. Next, the first ink-receiving layer coating liquid prepared above (temperature of the coating liquid: 40° C.) was applied onto the undercoat layer with a slide die such that the dry coating amount ($g/m^2$) was each value shown in Table 2, and dried with hot air at 150° C. Thus, recording media having a first ink-receiving layer were formed. Recording media having a first ink-receiving layer and a second ink-receiving layer were obtained by applying the first ink-receiving layer coating liquid and the second ink-receiving layer coating liquid (temperature of each of the coating liquids: 40° C.) using a simultaneous multi-layer coating technique with a slide die such that the dry coating amounts were the values shown in Table 2, and drying the coating liquids with hot air at 150° C. The thickness of the first ink-receiving layer of each of recording media 1 to 21 was 18 μm or more and 50 μm or less.

TABLE 2

| Coating conditions of recording medium | | | | |
|---|---|---|---|---|
| | Undercoat layer | First ink-receiving layer | | Second ink- |
| Recording medium No. | Amount of coating ($g/m^2$) | Ink-receiving layer coating liquid No. | Amount of coating ($g/m^2$) | receiving layer Amount of coating ($g/m^2$) |
| Recording medium 1 | 0.1 | Ink-receiving layer coating liquid 1 | 28.0 | — |
| Recording medium 2 | 0.3 | Ink-receiving layer coating liquid 1 | 28.0 | — |
| Recording medium 3 | 0.5 | Ink-receiving layer coating liquid 1 | 28.0 | — |
| Recording medium 4 | 0.7 | Ink-receiving layer coating liquid 1 | 28.0 | — |
| Recording medium 5 | 1.0 | Ink-receiving layer coating liquid 1 | 28.0 | — |
| Recording medium 6 | 1.2 | Ink-receiving layer coating liquid 1 | 28.0 | — |
| Recording medium 7 | 0.5 | Ink-receiving layer coating liquid 2 | 26.0 | — |
| Recording medium 8 | 0.5 | Ink-receiving layer coating liquid 3 | 27.0 | — |
| Recording medium 9 | 0.5 | Ink-receiving layer coating liquid 4 | 29.0 | — |
| Recording medium 10 | 0.5 | Ink-receiving layer coating liquid 5 | 30.0 | — |
| Recording medium 11 | 0.5 | Ink-receiving layer coating liquid 6 | 32.0 | — |
| Recording medium 12 | 0.5 | Ink-receiving layer coating liquid 7 | 18.0 | — |
| Recording medium 13 | 0.5 | Ink-receiving layer coating liquid 8 | 23.0 | — |
| Recording medium 14 | 0.5 | Ink-receiving layer coating liquid 9 | 33.0 | — |
| Recording medium 15 | 0.5 | Ink-receiving layer coating liquid 10 | 38.0 | — |
| Recording medium 16 | 0.5 | Ink-receiving layer coating liquid 11 | 43.0 | — |
| Recording medium 17 | 0.5 | Ink-receiving layer coating liquid 1 | 28.0 | 5.0 |
| Recording medium 18 | 0.5 | Ink-receiving layer coating liquid 1 | 28.0 | 10.0 |
| Recording medium 19 | 0.5 | Ink-receiving layer coating liquid 1 | 28.0 | 15.0 |
| Recording medium 20 | 0.5 | Ink-receiving layer coating liquid 1 | 28.0 | 20.0 |
| Recording medium 21 | — | Ink-receiving layer coating liquid 12 | 28.0 | — |
| Recording medium 22 | — | Ink-receiving layer coating liquid 13 | 28.0 | — |
| Recording medium 23 | — | Ink-receiving layer coating liquid 14 | 28.0 | — |

TABLE 2-continued

| Coating conditions of recording medium | | | | |
|---|---|---|---|---|
| | Undercoat layer | First ink-receiving layer | | Second ink-receiving layer |
| Recording medium No. | Amount of coating ($g/m^2$) | Ink-receiving layer coating liquid No. | Amount of coating ($g/m^2$) | Amount of coating ($g/m^2$) |
| Recording medium 24 | 0.5 | Ink-receiving layer coating liquid 15 | 25.0 | — |
| Recording medium 25 | — | Ink-receiving layer coating liquid 16 | 2.0 | 25.0 |

(Preparation of Recording Medium 26)

Recording medium 26 was obtained as in Recording medium 3 except that borax in the undercoat layer coating liquid was changed to orthoboric acid.

(Preparation of Recording Medium 27)

Recording medium 27 was obtained as in Recording medium 3 except that boric acid in the first ink-receiving layer coating liquid 1 was changed to borax.

Evaluation

<Measurement of FLOP Value of Recording Medium>

The values of $FLOP_{Max}$ and $FLOP_{Min}$ of Recording media 1 to 27 prepared above were measured by the method described above to calculate the value $FLOP_{Min}/FLOP_{Max}$. The results are shown in Table 3. In the case where the measurement could not be performed because, for example, the surface of a recording medium is significantly roughened, the results were denoted by "NO".

<Evaluation of Bleeding of Image in High-Humidity Environment>

Among Recording media 1 to 27, on the recording media whose FLOP values could be measured, solid images of cyan, magenta, and yellow (recording duty: 100%) were recorded using an ink jet recording device PIXUS MP990 (manufactured by CANON KABUSHIKI KAISHA) including an ink cartridge BCI-321 (manufactured by CANON KABUSHIKI KAISHA). The recording was conducted under the conditions of a temperature of 23° C. and a relative humidity of 50%. The resulting images were stored in a high humidity condition at a relative humidity of 90% at a temperature of 30° C. for one week, and bleeding of each of the images was then evaluated by visual observation. The evaluation criteria are as follows. The evaluation results are shown in Table 3. In the evaluation criteria described below, AA to B were defined as acceptable levels, and C was defined as an unacceptable level. In the above ink jet recording device, an image that is recorded under the condition that one ink droplet having a weight of about 11 ng is provided in a unit area of 1/600 inch×1/600 inch at a resolution of 600 dpi×600 dpi is defined as a recording duty of 100%.

AA: No bleeding occurred in all the color images.

A: Bleeding slightly occurred in any of the color images.

B: Although bleeding occurred in any of the color images, the bleeding was at a level that does not cause a problem.

C: Bleeding significantly occurred in any of the color images.

TABLE 3

| Evaluation results | | | | | |
|---|---|---|---|---|---|
| | Recording medium | FLOP value | | | Evaluation of bleeding of image in high-humidity |
| Example No. | No. | $FLOP_{Max}$ | $FLOP_{Min}$ | $FLOP_{Min}/FLOP_{Max}$ | environment |
| Example 1 | Recording medium 1 | 4.02 | 3.82 | 0.95 | A |
| Example 2 | Recording medium 2 | 4.17 | 4.17 | 1.00 | A |
| Example 3 | Recording medium 3 | 4.17 | 4.17 | 1.00 | A |
| Example 4 | Recording medium 4 | 4.17 | 4.17 | 1.00 | A |
| Example 5 | Recording medium 5 | 4.17 | 4.17 | 1.00 | A |
| Example 6 | Recording medium 6 | 4.17 | 4.17 | 1.00 | B |
| Example 7 | Recording medium 7 | 2.52 | 2.52 | 1.00 | A |
| Example 8 | Recording medium 8 | 3.23 | 3.23 | 1.00 | A |
| Example 9 | Recording medium 9 | 5.48 | 5.48 | 1.00 | A |
| Example 10 | Recording medium 10 | 5.90 | 5.90 | 1.00 | A |
| Example 11 | Recording medium 11 | 6.41 | 6.41 | 1.00 | B |
| Example 12 | Recording medium 12 | 4.17 | 4.17 | 1.00 | A |
| Example 13 | Recording medium 13 | 4.17 | 4.17 | 1.00 | A |
| Example 14 | Recording medium 14 | 4.17 | 4.17 | 1.00 | A |
| Example 15 | Recording medium 15 | 4.17 | 4.17 | 1.00 | A |
| Example 16 | Recording medium 16 | 4.17 | 4.17 | 1.00 | A |
| Example 17 | Recording medium 17 | 4.17 | 4.17 | 1.00 | AA |
| Example 18 | Recording medium 18 | 4.12 | 4.12 | 1.00 | AA |
| Example 19 | Recording medium 19 | 4.12 | 4.12 | 1.00 | AA |
| Example 20 | Recording medium 20 | 4.05 | 4.05 | 1.00 | AA |
| Example 21 | Recording medium 21 | 3.45 | 2.93 | 0.85 | B |
| Comparative Example 1 | Recording medium 22 | NO | NO | — | — |
| Comparative Example 2 | Recording medium 23 | 3.71 | 2.60 | 0.70 | A |
| Comparative Example 3 | Recording medium 24 | 0.11 | 0.11 | 1.00 | A |
| Comparative Example 4 | Recording medium 25 | 1.96 | 1.76 | 0.90 | A |

TABLE 3-continued

| Evaluation results | | | | | |
|---|---|---|---|---|---|
| | Recording medium | FLOP value | | | Evaluation of bleeding of image in high-humidity |
| Example No. | No. | $FLOP_{Max}$ | $FLOP_{Min}$ | $FLOP_{Min}/FLOP_{Max}$ | environment |
| Comparative Example 5 | Recording medium 26 | NO | NO | — | — |
| Comparative Example 6 | Recording medium 27 | NO | NO | — | — |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-018920 filed Jan. 31, 2012 and No. 2012-145663 filed Jun. 28, 2012, which are hereby incorporated by reference herein in their entirety.

What is claimed is:

1. A recording medium comprising:

a base; and at least one ink-receiving layer, wherein a first ink-receiving layer that is at least one ink-receiving layer contains inorganic particles having an average primary particle size of 1 μm or less and inorganic particles coated with a metal oxide, the inorganic particles coated with the metal oxide have an average primary particle size of 15.0 μm or more, and when the maximum of a FLOP value of the recording medium represented by the formula below is denoted by $FLOP_{Max}$ and the minimum of the FLOP value is denoted by $FLOP_{Min}$, the $FLOP_{Min}$ is 2.5 or more and a value of $FLOP_{Min}/FLOP_{Max}$ is 0.80 or more and 1.00 or less:

$$\text{FLOP value}=2.69\times(L^*_{15^\circ}-L^*_{110^\circ})^{1.11}/L^*_{45^\circ}{}^{0.86}$$

where $L^*_{15^\circ}$ denotes a brightness of reflected light at an offset angle of 15°, $L^*_{45^\circ}$ denotes a brightness of reflected light at an offset angle of 45°, and $L^*_{110^\circ}$ denotes a brightness of reflected light at an offset angle of 110°.

2. The recording medium according to claim 1, wherein the inorganic particles having an average primary particle size of 1 μm or less, which inorganic particles are contained in the first ink-receiving layer, contain at least one selected from alumina, hydrated alumina, and silica.

3. The recording medium according to claim 1, wherein the inorganic particles coated with the metal oxide, which inorganic particles are contained in the first ink-receiving layer, contain at least one selected from natural mica, synthetic mica, alumina, hydrated alumina, and silica, and the metal oxide contains at least one selected from titanium dioxide, iron oxide, and tin oxide.

4. The recording medium according to claim 1, wherein the content of the inorganic particles coated with the metal oxide, which inorganic particles are contained in the first ink-receiving layer, is 5.0% by mass or more and 25.0% by mass or less relative to the content of the inorganic particles having an average primary particle size of 1 μm or less, which inorganic particles are contained in the first ink-receiving layer.

5. The recording medium according to claim 1, wherein the inorganic particles having an average primary particle size of 1 μm or less, which inorganic particles are contained in the first ink-receiving layer, have an average primary particle size of 0.1 nm or more and 500 nm or less, and the inorganic particles coated with the metal oxide, which inorganic particles are contained in the first ink-receiving layer, have an average primary particle size of 15.0 μm or more and 300 μm or less.

6. The recording medium according to claim 1, wherein the recording medium includes the base, the first ink-receiving layer, and a second ink-receiving layer that are disposed in that order, the second ink-receiving layer contains inorganic particles having an average primary particle size of 1 μm or less, and the second ink-receiving layer has a thickness of 18 μm or more and 55 μm or less.

7. The recording medium according to claim 1, further comprising an undercoat layer containing borax, the undercoat layer being disposed between the base and the first ink-receiving layer.

8. The recording medium according to claim 7, wherein the content of borax in the undercoat layer is 0.1 $g/m^2$ or more and 1.2 $g/m^2$ or less.

9. The recording medium according to claim 1, wherein the first ink-receiving layer further contains a binder and a cross-linking agent and the content of the cross-linking agent in the first ink-receiving layer is 40% by mass or more and 60% by mass or less relative to the content of the binder in the first ink-receiving layer.

10. The recording medium according to claim 9, wherein the cross-linking agent is boric acid or a borate.

11. The recording medium according to claim 1, wherein the recording medium is obtained by the method including a step of forming an undercoat layer by applying an undercoat layer coating liquid containing borax on the base, and a step of applying a first ink-receiving layer coating liquid on the undercoat layer, and wherein the undercoat layer coating liquid does not contain polyvinyl alcohol or polyvinyl alcohol derivatives, or the total content of polyvinyl alcohol and polyvinyl alcohol derivatives in the undercoat layer is 0.1% by mass or less relative to the content of borax in case that the undercoat layer coating liquid contains polyvinyl alcohol or polyvinyl alcohol derivatives.

* * * * *